United States Patent [19]

Lin

[11] Patent Number: 4,837,894

[45] Date of Patent: Jun. 13, 1989

[54] SPRING BIASED ARM SNAP-TOGGLE HINGE

[76] Inventor: Tsong-Chi Lin, 146, Min Chyuan Rd., TaFu Village, FuNe Shiang, Kaohsiung Hsien, Taiwan

[21] Appl. No.: 197,168

[22] Filed: May 23, 1988

[51] Int. Cl.[4] ..... E05F 1/08

[52] U.S. Cl. ..... 16/288; 16/294; 16/302; 16/DIG. 43

[58] Field of Search ..... 16/50, 288, 294, 302, 16/DIG. 43

[56] References Cited

U.S. PATENT DOCUMENTS

| | | | |
|---|---|---|---|
| 3,363,281 | 1/1968 | Borsani | 16/288 |
| 4,075,735 | 2/1978 | Rock et al. | 16/50 |
| 4,251,900 | 2/1981 | Lautenschlager | 16/50 X |

*Primary Examiner*—Fred A. Silverberg

*Attorney, Agent, or Firm*—Larson and Taylor

[57] ABSTRACT

An improved snap-toggle hinge for furniture comprising a toggle segment and a first pivot arm both combined with a base plate, the toggle segment connected with a pin by way of a shaft, the shaft surrounded by a helical spring, a foot provided in the toggle segment able to insert in between two fixing pins provided in the second pivot arm when this hinge becomes closed up.

3 Claims, 4 Drawing Sheets

SPRING BIASED ARM SNAP-TOGGLE HINGE

BACKGROUND OF THE INVENTION

A snap-toggle hinge is widely used in opening the door of an article of furniture, able to pivotally turn for more than 90° and to keep the door in tightly closed position in spite of repeated opening or closing movement of the door. And it has to be provided with a powerful spring in order to enable the door to intensely shut up.

There is a kind of snap-toggle hinge patented with the U.S. Pat. No. 4,075,735, wherein a helical spring pushing a protrusion enters a hole, said protrusion including two guiding sliding blocks perpendicular to each other. This hinge often has a disorder that said spring jumps off its position, and a rather complicated structure for manufacturing.

SUMMARY OF THE INVENTION

In order to solve the problems in the art mentioned above, the present invention has been worked out to provide a snap-toggle hinge for furniture that has no such shortcoming and a comparatively easy structure for manufacture.

This hinge comprises a base plate for fixing the hinge on the door of an article of furniture, setting plates for fixing on the side wall of the article of furniture, a connecting member to be assembled with the setting plates, four pivot arms pivotally connected with one another and connected between the base plate and the connecting member, the first pivot arm and the base plate simultaneously connected with a toggle segment, said toggle segment connected with a pin by means of a shaft, and the top end of said pin inserting in a pin hole of the first pivot arm so that a foot provided in said toggle segment can insert in between two fixing pins set in the second pivot arm.

BRIEF DESCRIPTION OF THE DRAWINGS

An embodiment of the invention will now be described by way of example and with reference to the accompanying drawings, in which.

DETAILED DESCRIPTION OF THE INVENTION

Figure 1:
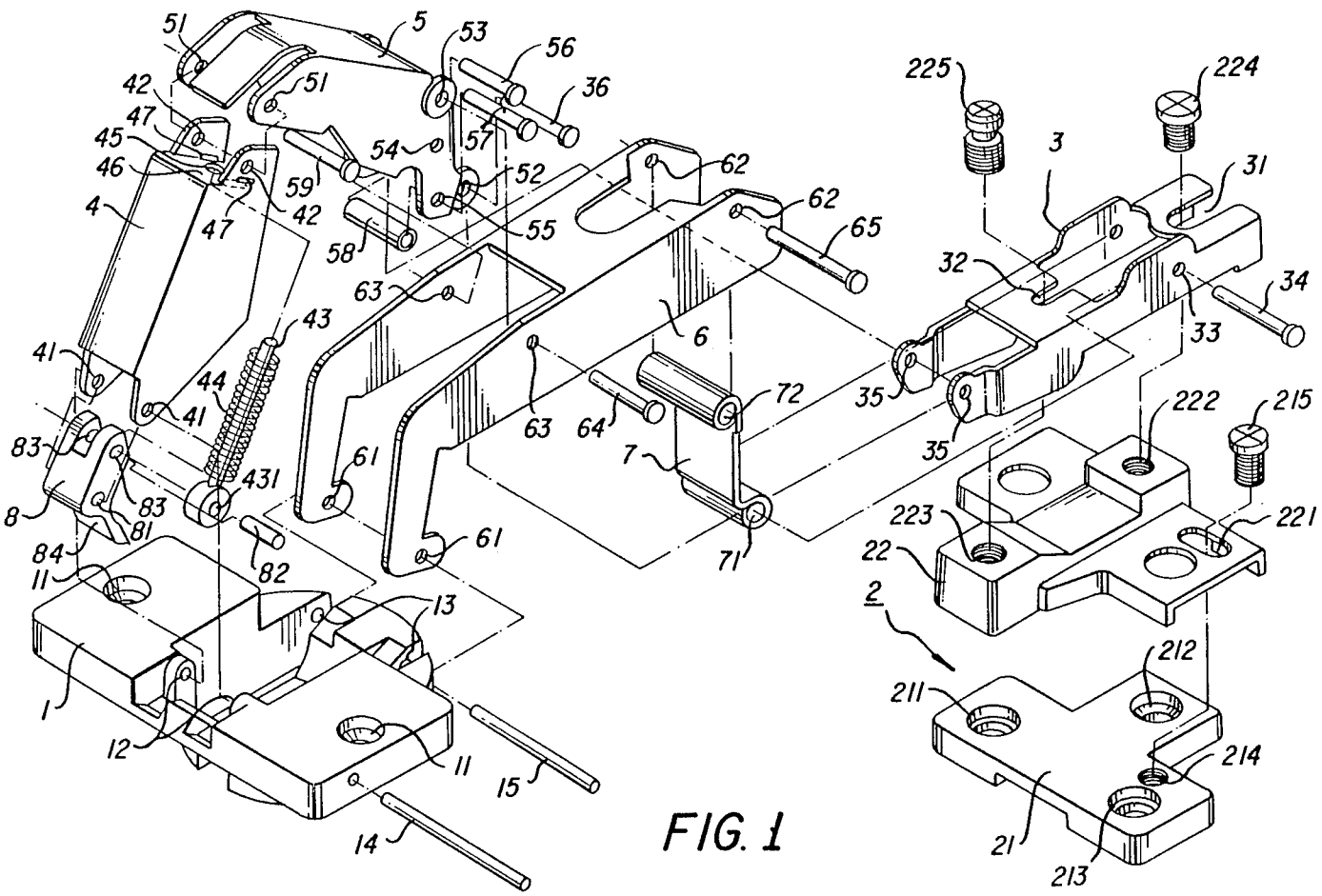
FIG. 1 is an exploded perspective of the snap-toggle hinge in accordance with the present invention.

Referring firstly to FIG. 1, this improved snap-toggle hinge comprises a base plate 1 to be fixed on the door of an article of furniture, setting plates 2 to be set on the side wall of the article of furniture, a connecting plate 3 to combine with the setting plates 2, a first pivot arm 4, a second pivot arm 5, a third pivot arm 6, a fourth pivot arm 7 and a toggle segment 8.

The base plate 1 is to be fixed on the door of some article of furniture by means of two holes 11 and bolts, and provided with two pairs of shaft holes 12 and 13; the shaft holes 12 are for a shaft 14 to insert in, said shaft 14 also inserting in shaft holes 41 in the first pivot arm 4 and a shaft hole 81 in a toggle segment 8; the shaft holes 13 are for a shaft 15 to insert in, said shaft 15 also inserting in a shaft hole 61 in the third pivot arm 6.

Setting plates 2 comprise a fixing plate 21 and a sliding plate 22; the fixing plate 21 is to be fixed on the side wall of some article of furniture, and provided with flat head bolt holes 211, 212, 213 for bolts to fix therein. The sliding plate 22 is provided with an oval hole 221, and a bolt 215 assembles said plate 22 with the fixing plate 21 screwing in the oval hole 221 and a bolt hole 214 in the fixing plate 21. The sliding plate is also provided with two bolt holes 222, 223, for bolts 224, 225 to assemble said setting plates 2 with a connecting member 3.

The connecting member 3 provided with two openings 31, 32 is assembled with the sliding plate 22 with the bolts 224, 225 screwing through said opening 31, 32 and the bolt holes 222, 223 in the sliding plate 22. The connecting member 3 is also provided with a shaft hole 33 for a shaft 34 to insert in so that the connecting member 3 can be assembled with the fourth pivot arm 7 with said shaft 34 inserting in both said shaft hole 33 and a shaft hole 71 in the fourth pivot arm 7.

The first pivot arm 4 is assembled with the base plate with a shaft 14 inserting in a shaft hole 12 in the base plate 1 and a shaft hole 41 provided in the first pivot arm 4; the shaft 14 also inserts through a shaft hole 81 in the toggle segment 8. The first pivot arm 4 is also provided with a shaft hole 42, and a shaft 59 assembled the first pivot arm 4 with the second pivot arm 5 inserting in said shaft hole 42 and a shaft hole 51 in the second pivot arm 5. A pin 43 surrounded lengthwise by a helical spring 44 is hidden inside the first pivot arm 4, and extends in a pin hole 45 in the first pivot arm 4 with its upper end and has a shaft hole 431 at its lower end for a shaft 82 to insert through for combining the first pivot arm 4 with the toggle segment 8 provided with a shaft hole 83 for said shaft 82 to insert through as well. When the toggle segment 8 is moved it can compress the spring 44, and when the force to move the toggle segment 8 disappears, it can be pushed back to its original position by the spring 44. As the top end of the spring 44 always pushes against a wall 46 in which the pin hole 45 is cut, said wall 46 has to be kept immovable at its position in order to prevent it from being pushed up by said spring 44 by means of two inside protrusions set on both sides of the first pivot arm 4.

The second pivot arm 5 is pivotally connected with the first pivot arm 4 by means of a shaft 59 inserting through shaft holes 51 in said arm 5 and shaft holes 42 in said arm 4, and also connected with the connecting member 3 by means of a shaft 36 inserting through shaft holes 52 in said arm 5 and shaft holes 35 in said member 3. The second pivot arm 5 is also pivotally connected with the third pivot arm 6 by means of a shaft 64 inserting through shaft holes 53 in said arm 5 and shaft holes 63 in said arm 6. The second pivot arm 5 is, in addition, also provided with a pin hole 54 for a fixing pin 56 to fix in and a pin hole 55 for a fixing pin 57 to fix in. A turnable cylinder 58 is lengthwisely placed around said pin 57 so that when a foot 84 of the toggle segment 8 touches the cylinder 58, said cylinder 58 can be turned around with mutual friction.

The third pivot arm 6 combined with the base plate 1 by means of a shaft 15 inserting through shaft holes 61 in said arm 6 and shaft holes 13 in said plate 1, is pivotally connected with the fourth pivot arm 7 by means of a shaft 65 inserting through shaft holes 62 in said arm 6 and a shaft hole 72 in said arm 7, and also pivotally connected with the second pivot arm 5 by means of a shaft 64 inserting through shaft holes 63 in said arm 6 and shaft holes 53 in said arm 5.

The fourth pivot arm 7 is connected with the connecting member 3 by means of a shaft 34 inserting through a shaft hole 71 in said arm 7 and shaft holes 33 in said member 3, and pivotally connected with the third pivot arm 6 as mentioned above.

The toggle segment 8 is pivotally connected with the base plate 1 and the first pivot arm 4 at the same time by means of a shaft 14 inserting through shaft holes 12 in said plate 1. And, the toggle segment 8 is also pivotally connected with the pin 43 by means of a shaft 82 inserting through shaft hole 83 in said toggle segment 8 and shaft hole 431 in said pin 43. Besides, the toggle segment 8 is also provided with a foot 84.

Figure 2:
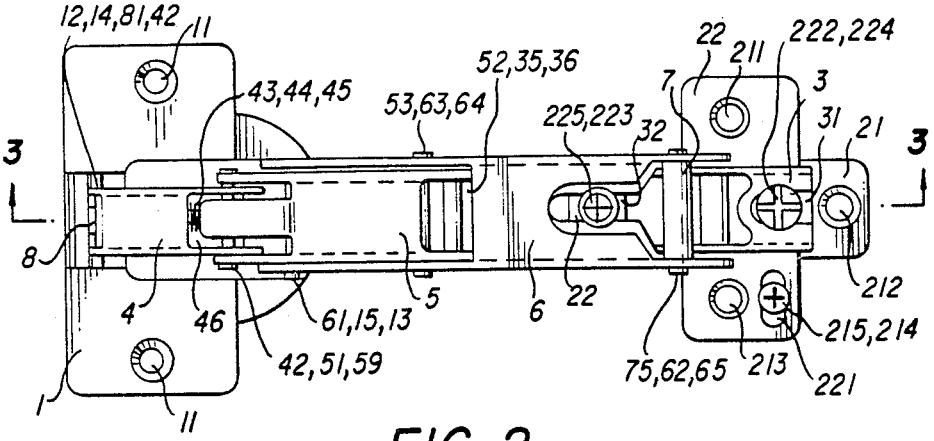
FIG. 2 is an upside view of the snap-toggle hinge in accordance with the present invention.
Figure 3:
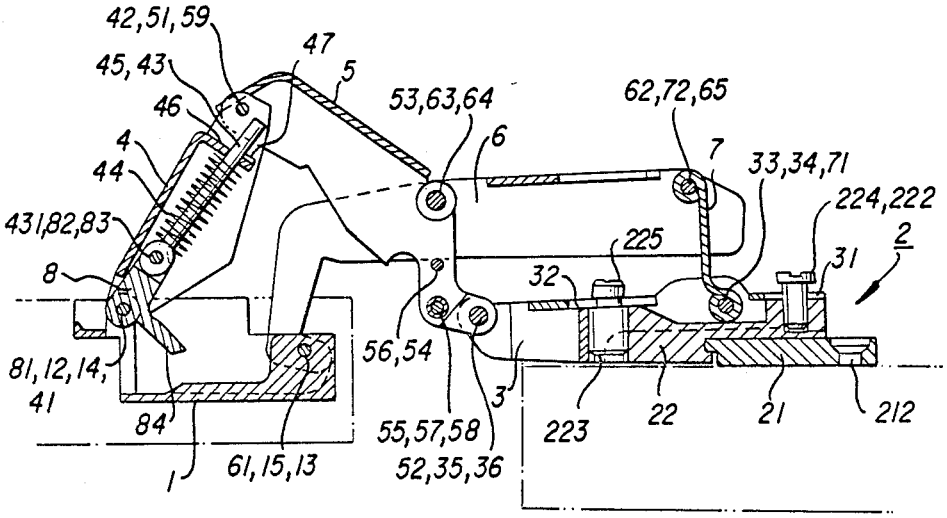
FIG. 3 is a cross-sectional view taken along line 3—3 of FIG. 2.

FIG. 2 shows that the base plate 1 is fixed on the door of an article of furniture and the setting plates 2 are fixed on the side wall of said article, the connecting member 3 assembled with said plates 2 with bolts 224, 225. FIG. 3 shows the pull-open situation of this hinge after the door has been opened. As each pivot arm is pivotally connected with one another in this hinge, so the operational movement of this hinge goes very smoothly.

Figure 4:
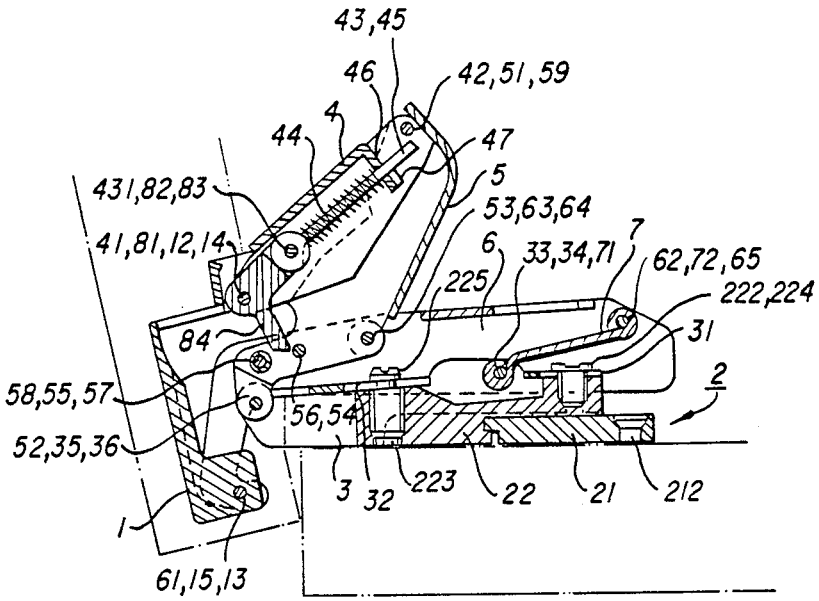
FIG. 4 is an operational view of this hinge in the closing movement.
Figure 5:
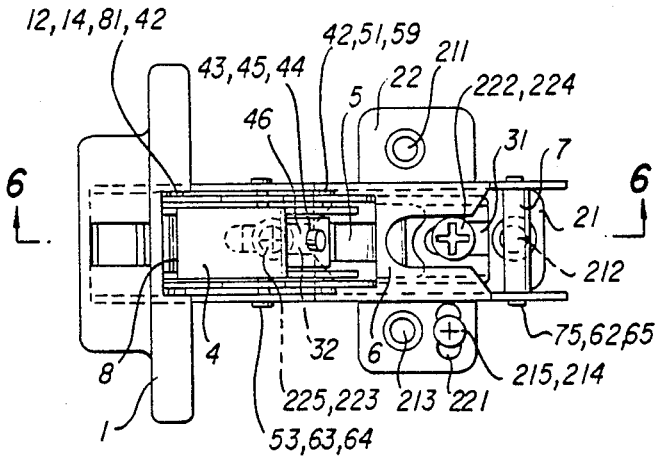
FIG. 5 is an upside view of this hinge in the closed position.
Figure 6:
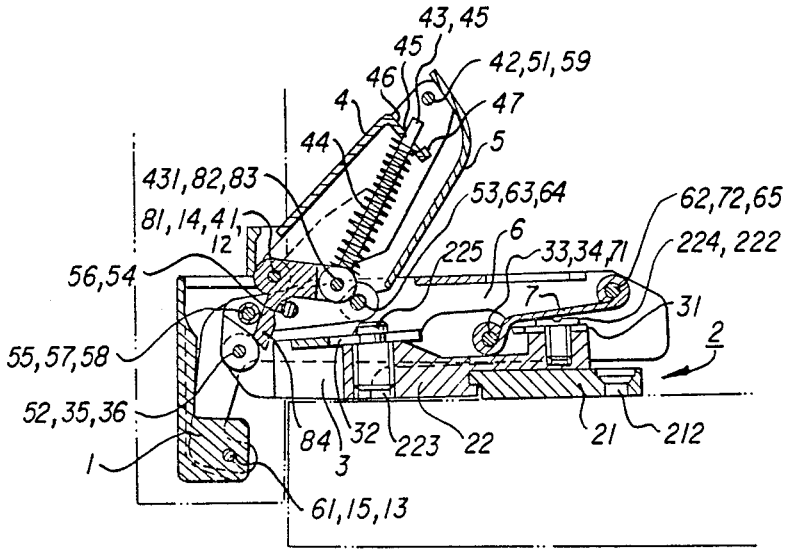
FIG. 6 is a cross-sectional view taken along line 6—6 of FIG. 5.

FIG. 4 shows that as the door is gradually closed the toggle segment 8 is forced to move and the foot 84 can insert in between the fixing pins 56 and 57, touching the cylinder 58 covered on said fixing pin 57. But the foot 84 can continue to move only straight downward restricted by both fixing pins 56, 57. Meanwhile the shaft 14 is approaching the shaft 64 and the shaft 14, and the shaft 82 and the pin hole 45 shown in FIG. 4 are nearly on a straight line with the shaft 82 situated a little higher. Then FIG. 6 shows the door is completely closed, and the positions of said shafts 14, 82 and said pin hole 45 shown in FIG. 4 gradually changes to the positions as shown in FIG. 6. During the process of the movement, the spring 44 can first be compressed and be released later, the fast speed of shutting the door being slowed down. The positions of said shafts 14, 82 and the pin 43 nearly show a right triangle and the toggle segment 8 is under the pressure of the spring 44, the door being under the condition of tight closing.

In general, is using this improved snap-toggle hinge the spring 44 can never fall off, therefore there is very little possibility that this hinge becomes out of order. Besides, the movement scope of the toggle segment 8 is under the guidance of the fixing pin 56 and the cylinder 58, the closing angle for the door being quite accurate, and it is comparatively easy to assemble this hinge, as the spring 44 is set to surround the pin 43 and said pin 43 is combined with the toggle segment by means of the shaft 82.

What is claimed is:

1. An improved snap-toggle hinge for furniture comprising;

a base plate to be fixed on the door of an article of furniture;

setting plates including a fixing plate and a sliding plate to be fixed on the side wall of the article of furniture;

a connecting member to be assembled with said setting plates;

four pivot arms connected with one another between said base plate and said connecting member; and a toggle segment connected with the first pivot arm by means of first shaft, a second pivot arm having two fixing pins spaced from the pivot axes of the second pivot arm, said first pivot arm being connected with the pin by means of a second shaft and an integral shaft hole in said pin, said pin having the shaft hole at one end and a free opposite end, said free end extending through and being supported by a hole in the first pivot arm, said pin being surrounded by a helical spring said toggle segment provided with an integral foot for inserting in between two fixing pins secured in the second pivot arm when said hinge is in the closed position.

2. The improved snap-toggle hinge for furniture as claimed in claim 1, wherein one of said fixing pins is provided with a cylinder covering it.

3. The improved snap-toggle hinge for furniture as claimed in claim 1, wherein the first shaft connecting the toggle segment and the base plate, the second shaft connecting the toggle segment and the pin and the shaft hole make up a little curved line when said hinge is opened, and the second shaft connecting the toggle segment and the pin being forced to move down and leftward when said hinge gradually closes up.

* * * * *